US007837217B2

(12) United States Patent
Avgustin et al.

(10) Patent No.: US 7,837,217 B2
(45) Date of Patent: Nov. 23, 2010

(54) SKI OR SNOWBOARD HAVING IMPROVED TORSIONAL RIGIDITY

(75) Inventors: Vinko Avgustin, Zirovnica (SI); Matej Bozicnik, Kamnik (SI); Marko Kozjek, Kamna Gorica (SI); Franci Smit, Bled (SI); Luka Grilc, Ljubljana (SI)

(73) Assignee: Elan, d.o.o., Begunje na Gorenjskem (SI)

( * ) Notice: Subject to any disclaimer, the term of this patent is extended or adjusted under 35 U.S.C. 154(b) by 86 days.

(21) Appl. No.: 11/995,909

(22) PCT Filed: Apr. 18, 2006

(86) PCT No.: PCT/SI2006/000013

§ 371 (c)(1),
(2), (4) Date: Jan. 16, 2008

(87) PCT Pub. No.: WO2007/011315

PCT Pub. Date: Jan. 25, 2007

(65) Prior Publication Data

US 2008/0238040 A1 Oct. 2, 2008

(30) Foreign Application Priority Data

Jul. 18, 2005 (SI) ..... P-200500208

(51) Int. Cl.
*A63C 5/07* (2006.01)

(52) U.S. Cl. ..... 280/602; 280/609

(58) Field of Classification Search ..... 280/14.21, 280/14.22, 28.14, 600, 601, 602, 608, 609, 280/610; 441/68, 74
See application file for complete search history.

(56) References Cited

U.S. PATENT DOCUMENTS 2,531,946 A * 11/1950 Parker ..... 441/74
2,605,111 A * 7/1952 Authier ..... 280/610
3,369,821 A * 2/1968 Weber ..... 280/610
3,738,675 A * 6/1973 Hashimoto ..... 280/610

(Continued)

FOREIGN PATENT DOCUMENTS

DE 3937617 A1 * 7/1990

(Continued)

OTHER PUBLICATIONS

DE 3937617 Al Translation.*

(Continued)

*Primary Examiner*—J. Allen Shriver, II
*Assistant Examiner*—Brodie Follman
(74) *Attorney, Agent, or Firm*—Smith Moore Leatherwood LLP

(57) ABSTRACT

A ski or snowboard having improved the transmission of forces from a binding mounting area to the respective edge of a ski or snowboard is disclosed. Such a ski or snowboard comprises a gliding surface with the associated edges as well as a lower support comprising a number of support layers over which a core with its associated lateral flanks is built. Over the core, a support is arranged in a uniform and relief-like manner that is constructed as a uniform whole from the shaped flat material, for example from laminate or in principle also from shaped sheet metal, or a plate or laminate or a similar flat semi-finished product of metallic or non-metallic material.

20 Claims, 7 Drawing Sheets

U.S. PATENT DOCUMENTS

| | | | | | |
|---|---|---|---|---|---|
| 4,280,715 | A | * | 7/1981 | Freelander et al. | 280/623 |
| 4,353,573 | A | * | 10/1982 | Morgan | 280/606 |
| 4,697,820 | A | * | 10/1987 | Hayashi et al. | 280/609 |
| 4,867,721 | A | * | 9/1989 | Fisher | 441/68 |
| 4,961,592 | A | * | 10/1990 | Diard et al. | 280/609 |
| 5,141,243 | A | * | 8/1992 | Meatto | 280/602 |
| 5,143,395 | A | * | 9/1992 | Mayr | 280/602 |
| 5,199,734 | A | * | 4/1993 | Mayr | 280/602 |
| 5,232,241 | A | * | 8/1993 | Knott et al. | 280/607 |
| 5,238,260 | A | * | 8/1993 | Scherubl | 280/610 |
| 5,427,401 | A | | 6/1995 | Liard | |
| 5,441,296 | A | * | 8/1995 | Phelipon et al. | 280/602 |
| 5,553,884 | A | * | 9/1996 | Abondance | 280/609 |
| 5,775,715 | A | * | 7/1998 | Vandergrift | 280/602 |
| 5,884,932 | A | * | 3/1999 | Ignatius | 280/602 |
| 5,988,668 | A | * | 11/1999 | DeVille et al. | 280/602 |
| 6,056,311 | A | * | 5/2000 | Leung | 280/609 |
| 6,217,041 | B1 | * | 4/2001 | Hauser et al. | 280/14.22 |
| 6,679,513 | B1 | | 1/2004 | Emig et al. | |
| 6,834,880 | B2 | * | 12/2004 | Deborde et al. | 280/607 |
| 6,994,369 | B2 | * | 2/2006 | Restani | 280/610 |
| 7,185,908 | B2 | | 3/2007 | Emig | |
| 7,275,755 | B2 | * | 10/2007 | Marion | 280/602 |
| 7,338,066 | B2 | * | 3/2008 | Riepler | 280/610 |
| 7,341,271 | B2 | * | 3/2008 | Bunter | 280/602 |
| 2001/0052679 | A1 | * | 12/2001 | Stubblefield | 280/14 |
| 2002/0084624 | A1 | * | 7/2002 | Jacobson | 280/604 |
| 2002/0089149 | A1 | * | 7/2002 | Barbieri et al. | 280/609 |
| 2003/0090086 | A1 | * | 5/2003 | Gousie | 280/607 |
| 2003/0111824 | A1 | * | 6/2003 | Riepler | 280/610 |
| 2003/0146599 | A1 | * | 8/2003 | Stefanova et al. | 280/609 |
| 2003/0151229 | A1 | * | 8/2003 | Muff, Jr. | 280/608 |
| 2004/0084878 | A1 | * | 5/2004 | Adamczewski | 280/602 |
| 2006/0186618 | A1 | * | 8/2006 | Bregeon et al. | 280/14.21 |
| 2006/0226613 | A1 | * | 10/2006 | Wilson | 280/14.22 |
| 2007/0205582 | A1 | * | 9/2007 | Himmetsberger et al. | 280/609 |

FOREIGN PATENT DOCUMENTS

| | | | | |
|---|---|---|---|---|
| DE | 19917992 | A1 | | 11/2000 |
| DE | 10254063 | | | 6/2004 |
| EP | 1166832 | A1 | | 1/2002 |
| EP | 1350543 | A1 | | 10/2003 |
| FR | 908396 | | | 4/1946 |
| FR | 1254377 | | | 2/1961 |
| FR | 2696354 | A1 | | 4/1994 |
| FR | 2882269 | | * | 8/2006 |
| JP | 62016777 | A | | 1/1987 |
| WO | 2004/045727 | A1 | | 6/2004 |

OTHER PUBLICATIONS

Neutral Axis (NA) Location of the Composite Beams section in eCourse "MECHANICS" developed by Dr. Kurt Gramoll at the University of Oklahoma, Norman, OK; webpage, http://www.ecourses.ou.edu/cgi-bin/ebook.cgi?doc=&topic=me&chap_sec=06.1&page=theory.

Composite Beams section in eCourse "MECHANICS" developed by Dr. Kurt Gramoll at the University of Oklahoma, Norman, OK; starting at webpage, http://www.ecourses.ou.edu/cgi-bin/ebook.cgi?doc=&topic=me&chap_sec=06.1&page=case_intro.

Unsymmetric Bending in eCourse "MECHANICS" developed by Dr. Kurt Gramoll at the University of Oklahoma, Norman, OK; starting at webpage, https://ecourses.ou.edu/cgi-bin/ebook.cgi?doc=&topic=me&chap_sec=06.3&page=case_intro.

Gramoll, K., "A Web-based Electronic Book (eBook) for Solid Mechanics,"ASEE Annual Conf. Proc., Honolulu, HI, Jun. 25-27, 2007; Copyright © 2007; webpage, http://comp.uark.edu/~jjrencis/aseemechanics/awards/papers/2007.pdf.

International Search Report mailed on Sep. 4, 2006 in PCT/SI2006/000013.

Written Opinion mailed on Sep. 4, 2006 in PCT/SI2006/000013.

English Translation of International Preliminary Report on Patentability mailed Jun. 19, 2008 in PCT/S12006/000013.

* cited by examiner

SKI OR SNOWBOARD HAVING IMPROVED TORSIONAL RIGIDITY

This application is a national stage application under 35 U.S.C. 371 of international application No. PCT/SI2006/000013 filed Apr. 18, 2006, and claiming priority to Slovenian Application No. P-200500208 filed Jul. 18, 2005, the disclosures of which are expressly incorporated herein by reference.

The invention relates to a ski or snowboard, in particular to measures to ensure a corresponding rigidity, particularly a torsional rigidity of the ski or snowboard, which is reflected in at least several embodiments also by an aspect of an embodiment relating to an upper surface of a ski or snowboard.

Accordingly, an embodiment of the invention is based on the problem of how to improve the transmission of forces from the binding mounting area to the respective edge of a ski or snowboard, i.e., how to increase the torsional rigidity and to reduce torsional deformations around the longitudinal axis without interfering with the existing flexural characteristics and dimensions of the ski or snowboard, and in particular, without any add-ons that would interfere with the conventional dimensional frame of currently available skis or snowboards, or that would be arranged outside of their conventional dimensional frame.

Hereinafter, for the sake for clarity, only the term "ski" will be used; however, "ski" will also refer analogously to "skis and/or snowboards." Even though a snowboard has two shovel sections instead of one shovel (tip) section and a tail as is the case with a ski, the invention is suitable and appropriate in a fully identical manner for snowboards.

As is commonly known, the ski when in use is subjected to a considerable degree to bending forces. In addition, those skilled in the art are certainly aware that the ski is subjected, at least under certain situations during use, to torsional loads, specifically in the curve when the inside edge in the front and/or rear section of the ski lies on the underlying element, while the gliding surface at least can be moved away primarily also by the substratum. In that instant, a relatively strong force acts on the edge that with the moment arm, corresponding to one half of the ski width, generates a torsional moment around the central longitudinal axis of the ski. Particularly in so-called carving skis, the ski width is considerably greater in the front and rear sections than in traditional skis. The moment arm is correspondingly greater as is the torsional load resulting from it. The torsional deformations that are a consequence of these loads change the ski geometry and thus have a substantial negative effect on the skiing characteristics of the ski. Accordingly, an aspect of an embodiment of the present invention is to eliminate the mentioned torsional deformations to the greatest degree, without significantly influencing the flex characteristics or the required flexion elasticity of the ski.

The problem of ensuring the necessary torsional rigidity of the ski around the longitudinal axis while simultaneously maintaining the required flex capability of the ski in the longitudinal direction has been addressed in conjunction with several solutions found in patent literature.

Thus, for example, FR 1.254.377 proposes that an additional construction element be built into the ski, namely a sine-shaped strip along the side of the ski, which, on the one hand, is practically unrestricted in its flexion in the longitudinal direction, while on the other hand it ensures a relatively high torsional rigidity of the ski, if at least the amplitudes are sufficiently great. The concept itself, as it is, satisfactorily solves the identified problem, but its practical realization is associated with a host of other unsolvable problems. While in use, the deformations of the individual sections of the aforementioned sine-shaped element are too large to be able to connect the element with the remaining construction sections of the ski and for these sections then to be able to form a uniform whole of a commercially acceptable product. The lower tips of the element are, for example, connected with the lower construction elements or directly with the gliding surface and with the edges, while the upper tips are connected to the shell, which forms the upper surface of the ski, including with the plate for mounting the ski bindings, whereby the lateral flanks are intended to compensate for all relatively high relative displacements between the upper and lower tips of the sine-shaped elements, which is practically impossible. In addition, a sufficient increase in the torsional stiffness is only ensured for the case where the amplitudes of the curvature of the strip are large enough, which in practice means that the height of the ski becomes considerably greater, which is generally not desired.

In DE 199 17 992 A1, a similar solution is applied in a different manner; specifically, once again a wave-shaped reinforcing element is used in the longitudinal direction, which is both flexible and torsionally rigid. This element is designed as a parabola that transitions into a sinusoid at its ends and is accordingly bent away from the substrate in the central area of the ski, i.e., in the ski binding mounting area, while in the front and rear sections of the ski, it is first bent downward against the substrate and then back up again in the direction toward the tip or tail of the ski; approximately in the neutral axis of the ski, it is interrupted or enclosed. The reinforcing element itself is designed as a strip that narrows in the middle section, and is an aspect of an embodiment expanded in the front and rear sections of the ski and, as mentioned, also curved at the same time. Furthermore, the reinforcing element is provided with centrally arranged openings through which an essentially straight flexible guide element is pushed, upon which the mentioned flat reinforcing element is emplaced so that the guide element penetrates the reinforcing element or runs through the waves of the mentioned reinforcing element. Another construction provides for two rod-shaped carriers running in the longitudinal direction of the ski and mutually spaced apart in the transverse direction that are basically curved in a similar manner as the strip in the previous construction; the mentioned rod-shaped carriers are pushed through the correspondingly arranged openings in a guide element constructed as a strip. In another construction, rod-shaped carriers curved in the described manner are pushed through the corresponding longitudinal guides, which are attached on the guide element designed as a strip. Each of the mentioned constructions should be installable in a corresponding hollow in the longitudinal direction of the ski and, thanks to the effects in conjunction with their ability to ensure torsional rigidity, they should allow a more uniform pressure distribution over the entire length of the respective active ski edge. This would be true in the case where the amplitudes of the curvature of the reinforcing elements would be great enough, which would again result in a tremendous increase in the height of the ski, especially in the middle section, i.e., in the ski binding mounting area, which, however, is limited by regulations, as in the case of competition skis.

Furthermore, DE 102 54 063 or PCT/DE2003/003788 (WO 2004/045727) describes a ski in which once again a reinforcing element is provided that is designed as a sine-shaped, curved strip running along the side of the ski, that is provided with openings on the sides through which the spaced-apart bindings are inserted, that run in just this way along the ski and each of which is attached in the front and back sections of the ski. The mentioned sine-shaped, curved band is also slightly flexible, whereby the mentioned bindings provide the corresponding pre-loading of the ski to ensure the necessary flexural rigidity. In addition, the sine-shaped, curved strip ensures a certain torsional rigidity, however again only in the case where the amplitudes of the sine-shaped curvature are sufficiently great. In this case also, increasing the height of the ski is unavoidable so that the height of the ski then deviates substantially over almost the entire length from the height of conventional, commercially available skis that are interesting to the market.

Then again, EP 1 166 832 A1 deals with a ski in which a flat reinforcing element is attached over the entire length of the ski, as viewed in a transverse plane, but in the upper portion, i.e., under the upper surface of the ski and at a distance from the neutral bending axis of the respective cross-section; it is attached under a laminate shell that is impregnated with synthetic resin and comprises only in the middle section of the ski two lengthwise, spaced-apart ribs each bent upward in the shape of the letter V or a U, as viewed from the side. The mentioned metal element is wider in the front and rear sections of the ski, but narrower in the middle section of the ski. In any event, the presence of the mentioned ribs in the middle part of the ski can, for example, influence the increase in the flexural rigidity in the middle part of the ski. In any event, the presence of the mentioned flat metal reinforcing element, taking into account the greater width in the front and back sections, substantially increases the weight of the ski, but does not contribute significantly to improving the torsional rigidity of the ski in its front and rear sections.

Besides these solutions that are also discussed in the patent literature, a few other solutions are also currently available according to prior art; the most relevant of these are described below in relation to one of the embodiments of the invention.

Aspects of embodiments of the invention relate to a ski or snowboard having improved torsional rigidity, namely either On a ski, in which a location to mount the ski bindings is provided in the middle section on the upper surface, or it is provided with at least one part of the assembly installed in it for the adjustable mounting of the ski bindings, and whose front section arranged in front of the middle section is integrated with the shovel (tip) section, while the rear section arranged behind the middle section is integrated with the tail of the ski, and which comprises on the side turned away from the substrate a gliding surface arranged between the edges over which the lower support assembly consisting of the corresponding number of support layers is provided, over which is located the core that is surrounded optionally by the associated side flanks and/or the top layer to protect it from undesired external influences and mechanical damage, whereby the width of the ski is smaller in the middle section than in the front and back sections of the ski or Analogously also on a snowboard in which, taking into account the already mentioned properties, a tail is present in the rear section as in a ski or instead of a ski tail, there is an additional shovel section.

A ski or snowboard according to aspects of embodiments of the invention comprises a support, arranged uniformly in a relief-like manner over the core, whose support elements, namely the external support regions and the corresponding number of indentations, including the bottom of the respective indentation, are arranged in at least two planes, whereby at least one of the planes is located in the vicinity of the neutral bending axis, or even coincides with this neutral bending axis, while the other plane is, or the other planes are, arranged at a distance from the neutral bending axis in a direction away from the substrate, and whereby the support is provided with at least one indentation in the front and back sections of the ski or analogously at least in the middle section of the snowboard, while the lateral support sections run over the middle section, as well as over the front and back sections of the ski.

A support is provided with at least one indentation in the front and back sections of the ski or snowboard, which comprises a bottom designed in a relief-like manner with the associated walls, whereby the bottom of at least one indentation forms a set of periodically repeating downward or upward arcs in the longitudinal direction of the ski or snowboard, which are constructed as cambered fields or as periodically repeating, sine-shaped undulating upward and downward arcs.

A width of the indentation or its bottom can vary along the front section and/or along the rear section of the ski or snowboard either in accord with the change in width or proportionally with the change in width of the ski or snowboard in its longitudinal direction from the smallest width to the greatest width.

The width of the respective external support region of the support along the front section and/or along the rear section of the ski or snowboard can be either variable or invariable.

A spacing or a period of the upward or downward arcs in the set along the associated indentation on the support in the respective section of the ski or snowboard can be either invariable or gradually variable so that, when viewed in the direction away from the middle section of the ski or snowboard, it gradually diminishes from the starting value to a final value.

A depth of the indentation, i.e., the distance between a plane in which the bottom of the indentation is located and a plane in which the support sections are located, can also be variable along the front and/or rear sections of the ski.

Aspects of embodiments of the invention will be described below with examples of the constructions that are depicted in the following drawings.

Figure 5:
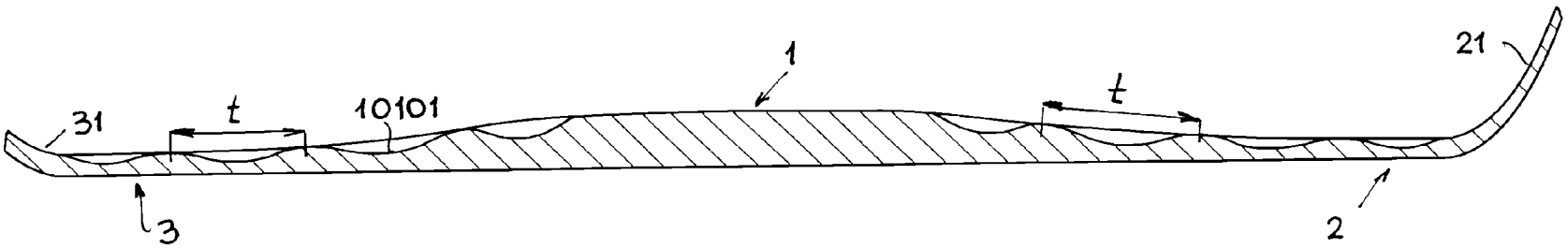
Figure 6:
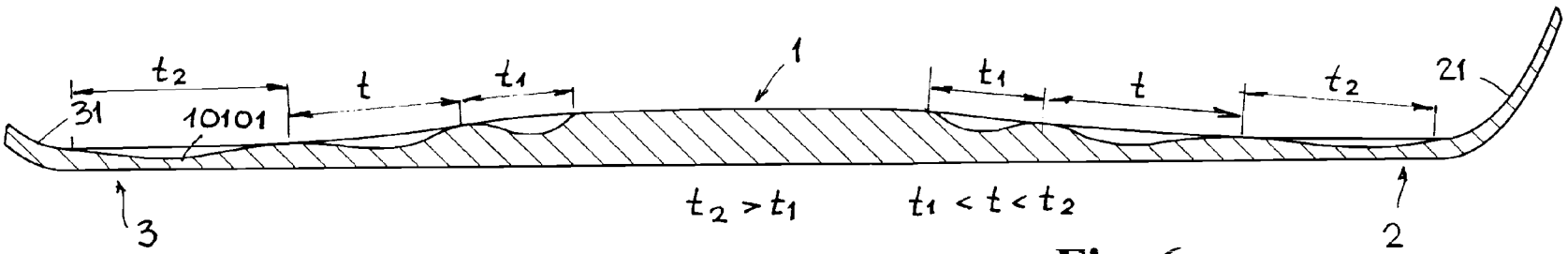
Figure 7:
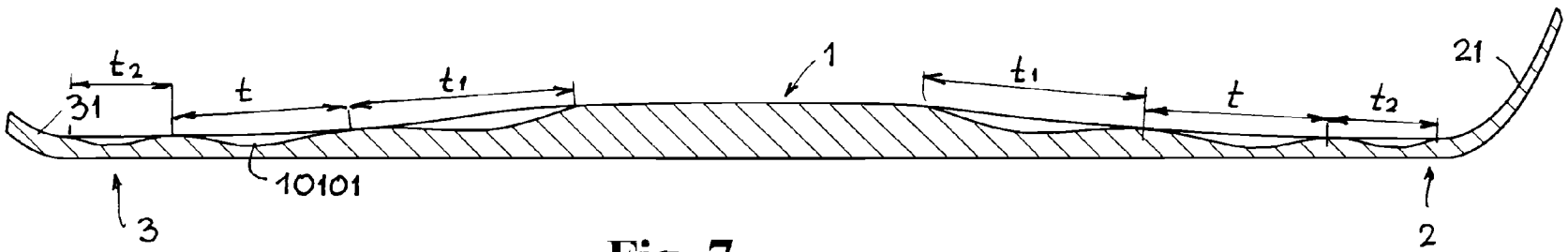
Figure 8:
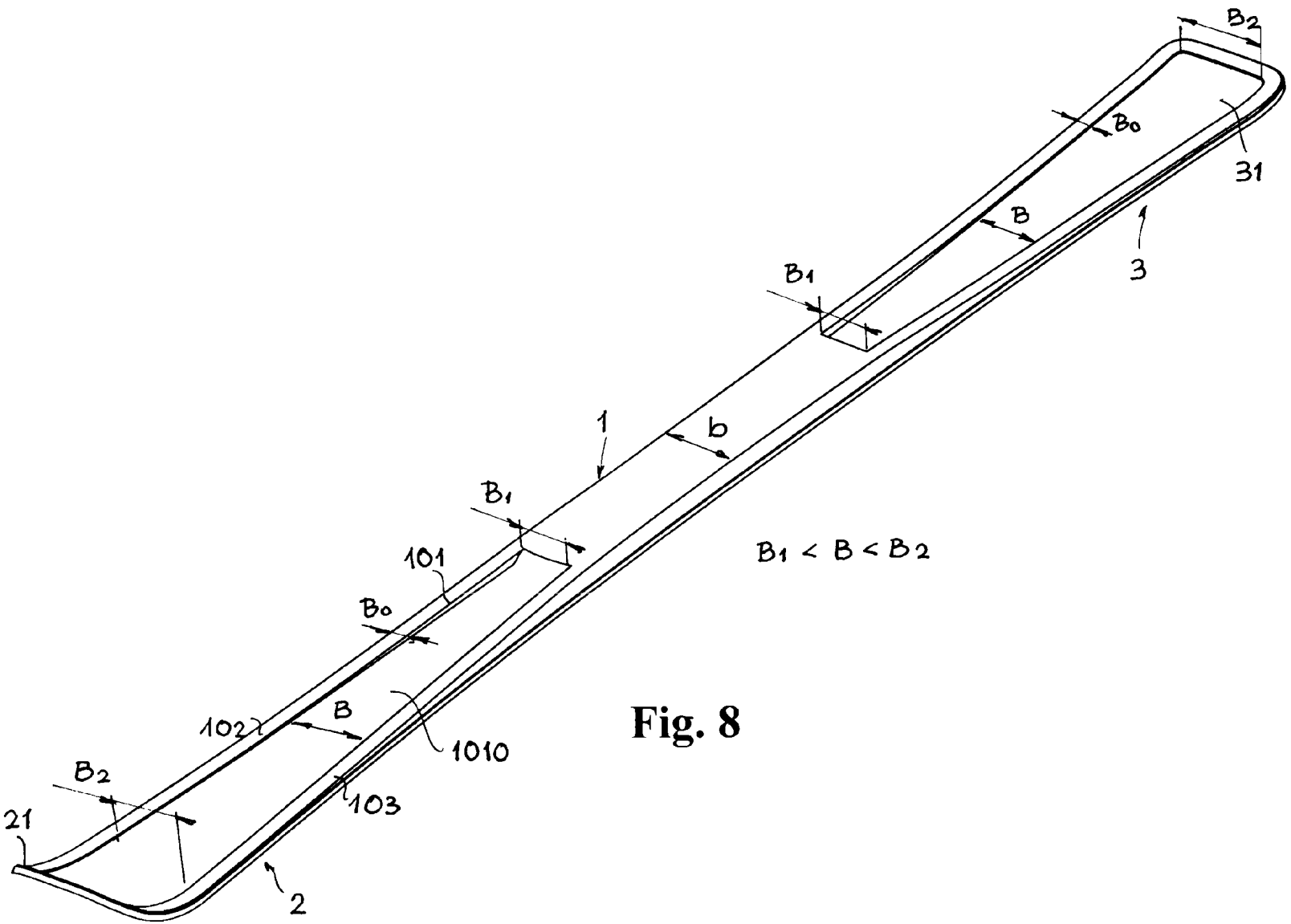
Figure 9:
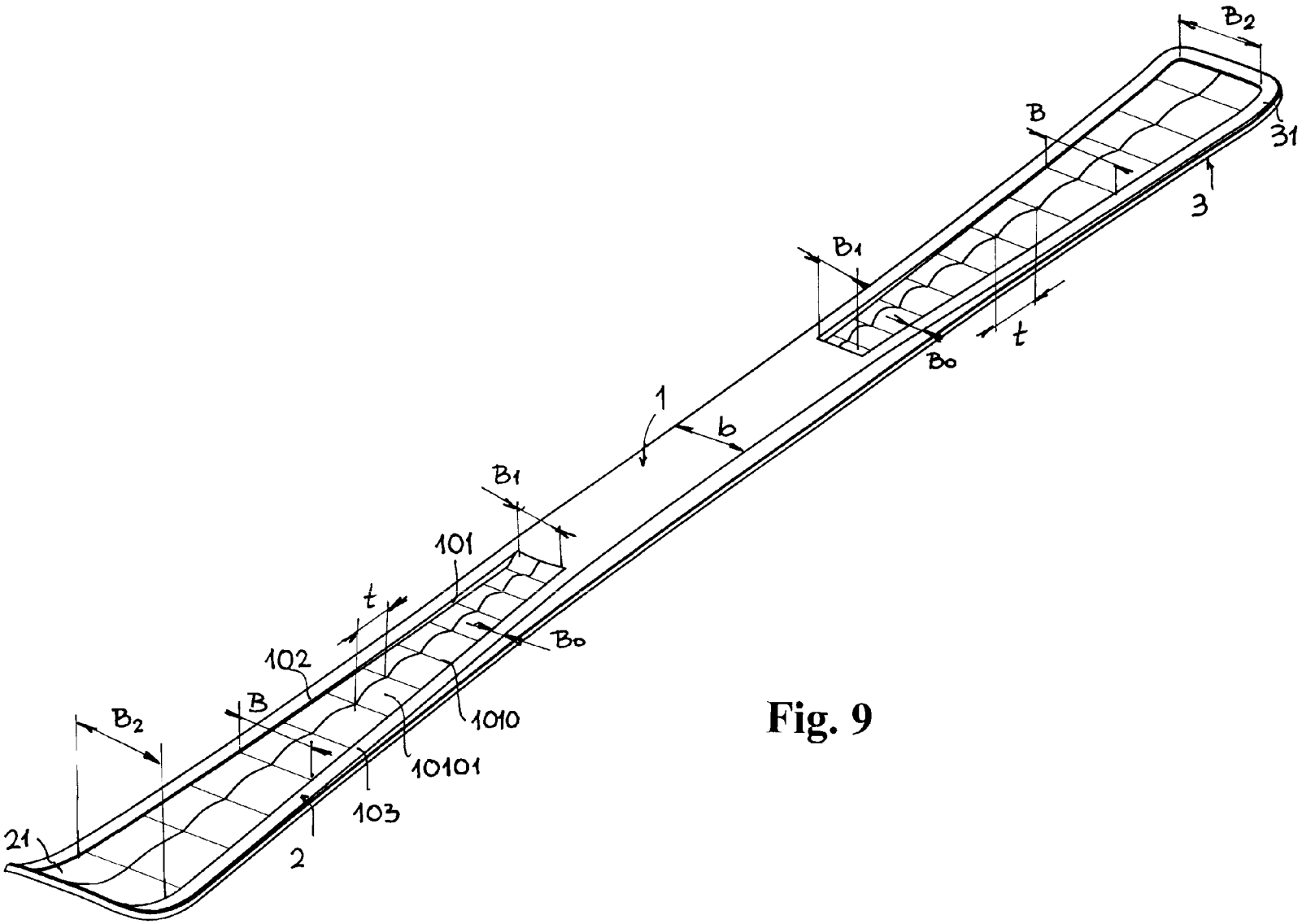
Figure 10:
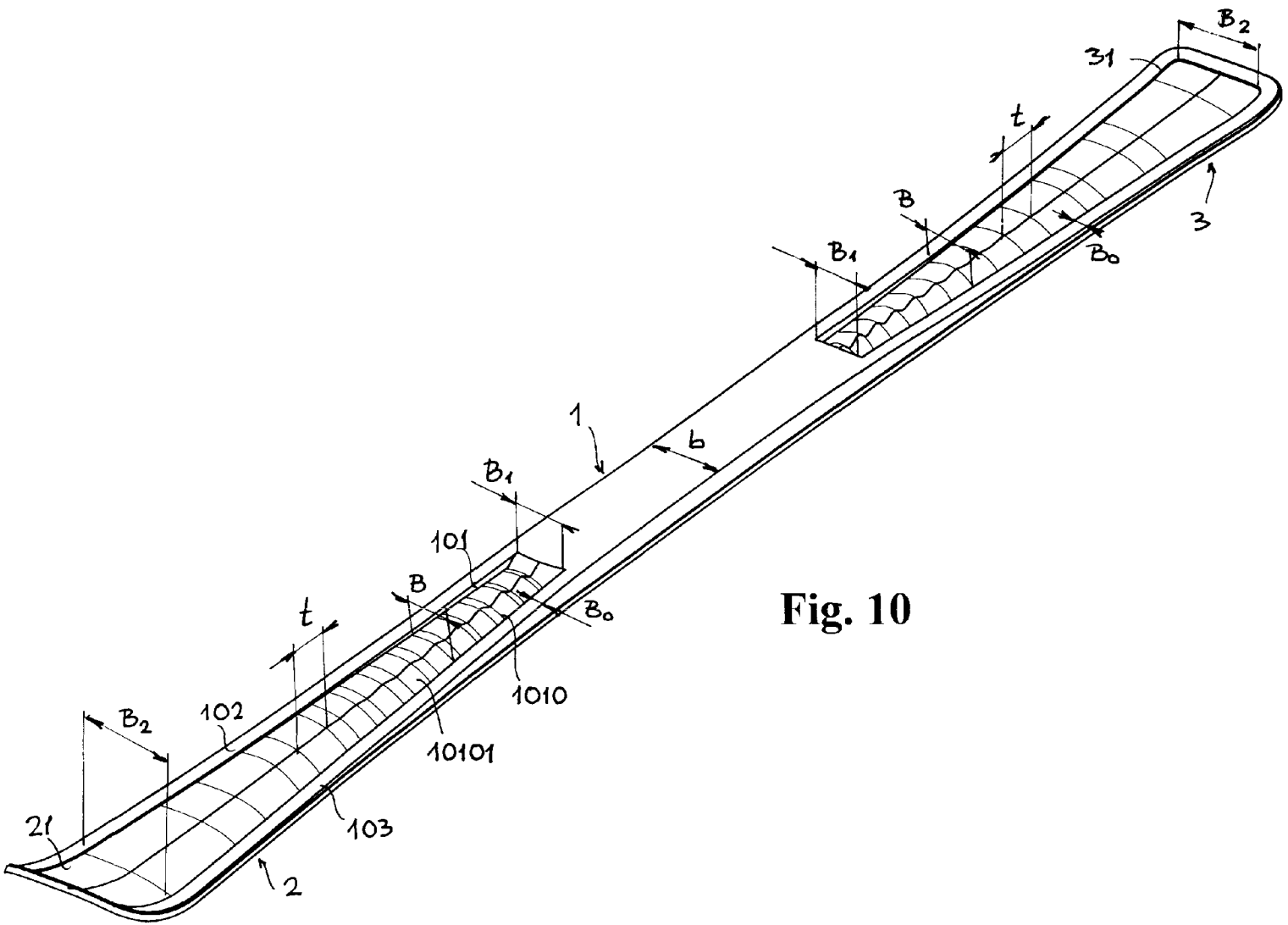
Figure 11:
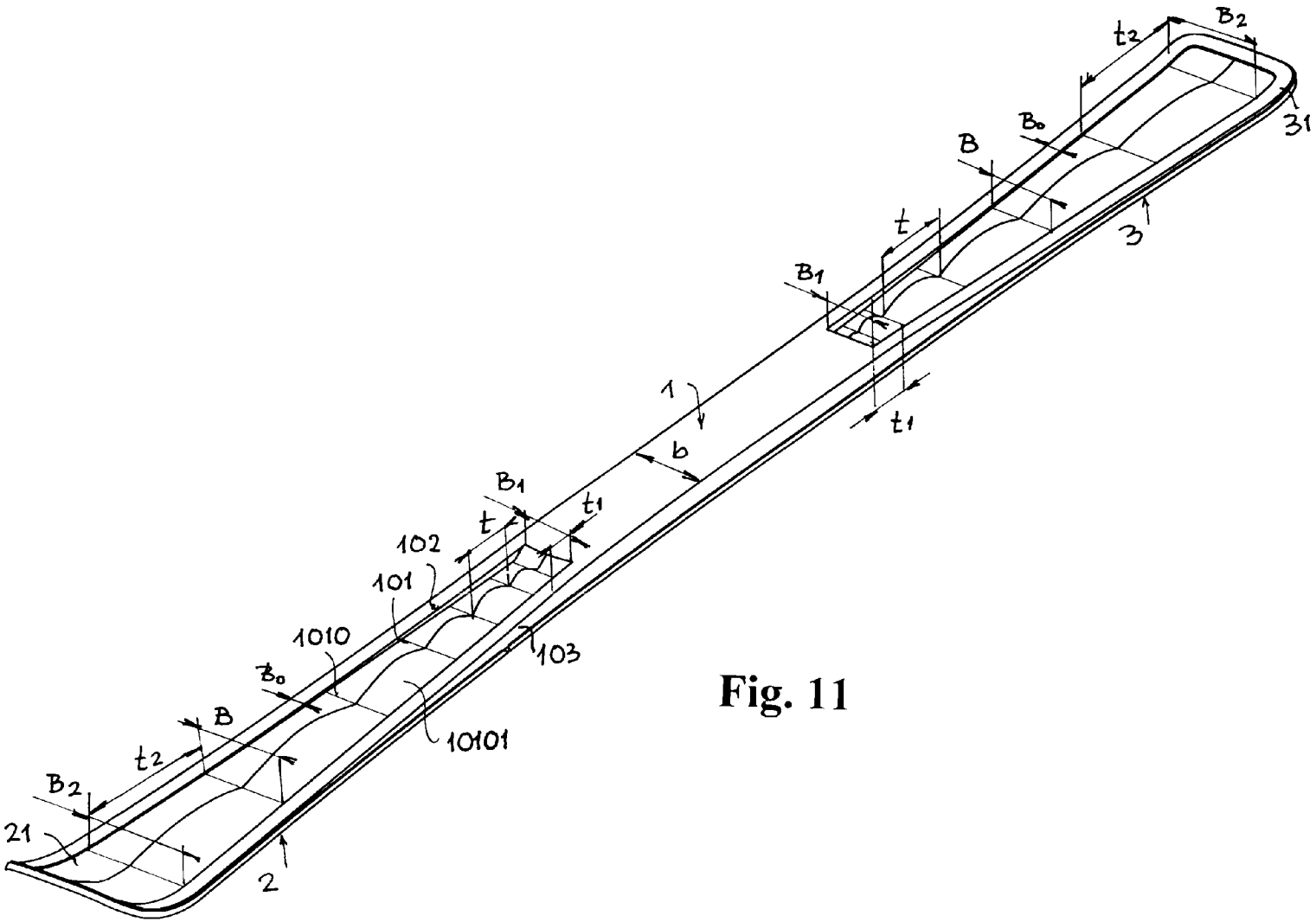
Figure 12:
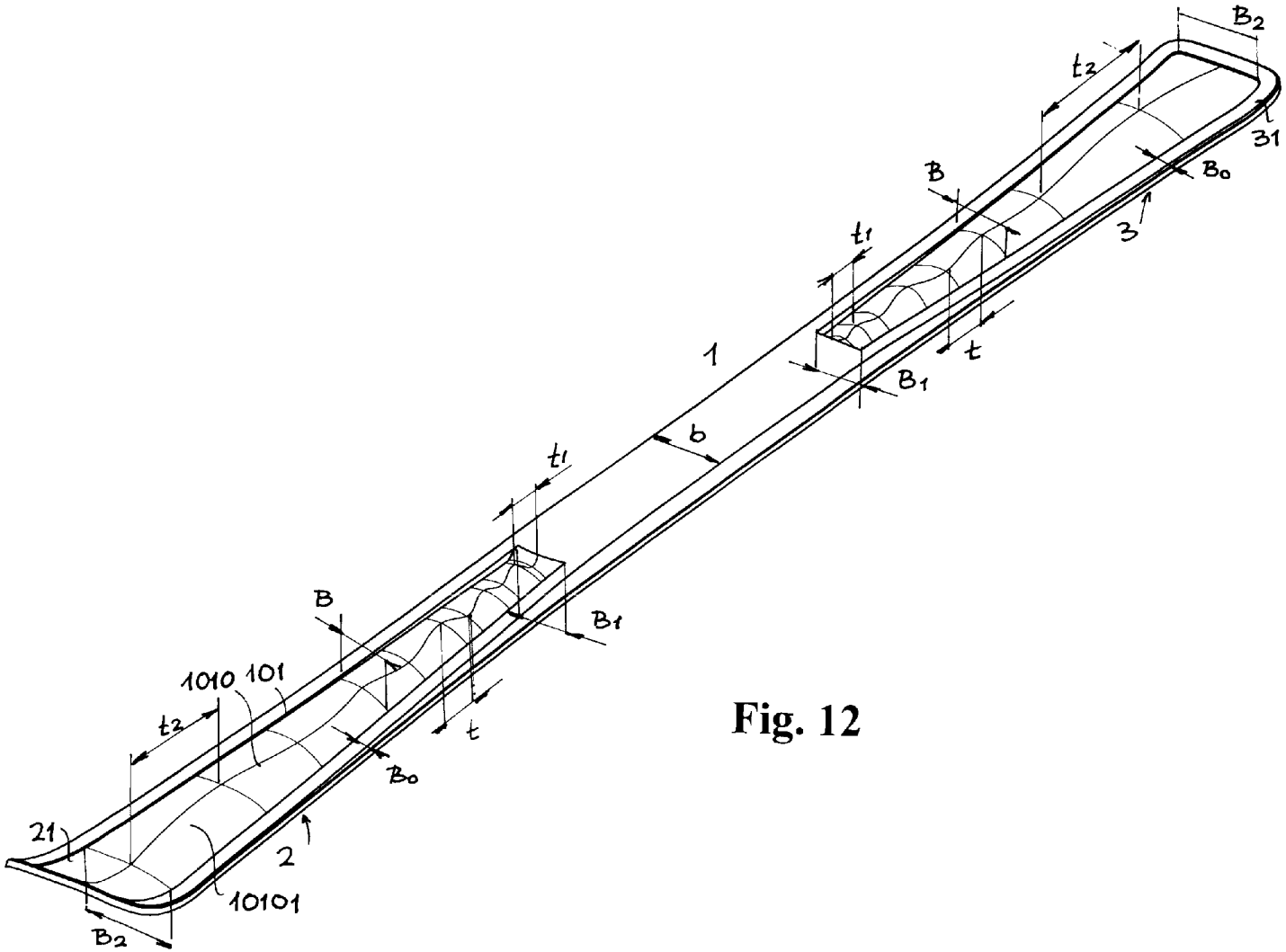

FIG. 5 schematically depicts a longitudinal cut of one of the possible examples of a ski in accordance with an aspect of an embodiment of the invention;

FIG. 6 schematically depicts a longitudinal cut of another possible example of the ski in accordance with an aspect of an embodiment of the invention;

FIG. 7 schematically depicts a longitudinal cut of another example of the ski in accordance with an aspect of an embodiment of the invention;

FIG. 8 schematically depicts in a perspective view of one of the possible examples of the ski in accordance with an aspect of an embodiment of the invention;

FIG. 9 schematically depicts in a perspective view another example of the ski in accordance with an aspect of an embodiment of the invention;

FIG. 10 schematically depicts in a perspective view another example of the ski in accordance with an aspect of an embodiment of the invention;

FIG. 11 schematically depicts in a perspective view another example of the ski in accordance with an aspect of an embodiment of the invention; and FIG. 12 schematically depicts in a perspective view another example of the ski in accordance with an aspect of an embodiment of the invention.

Figure 1:
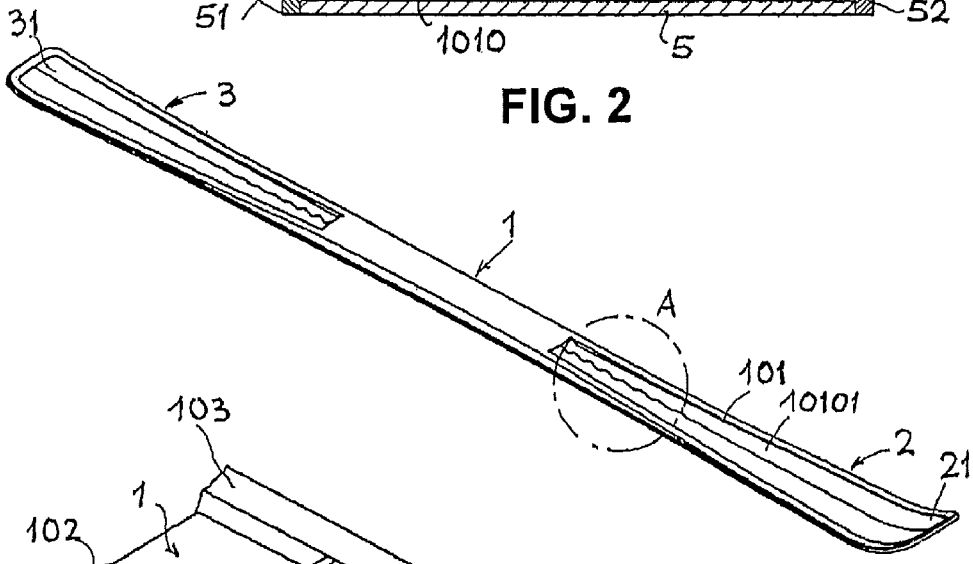
FIG. 1 depicts a ski in accordance with an aspect of an embodiment of the invention from a perspective view.
Figure 4:
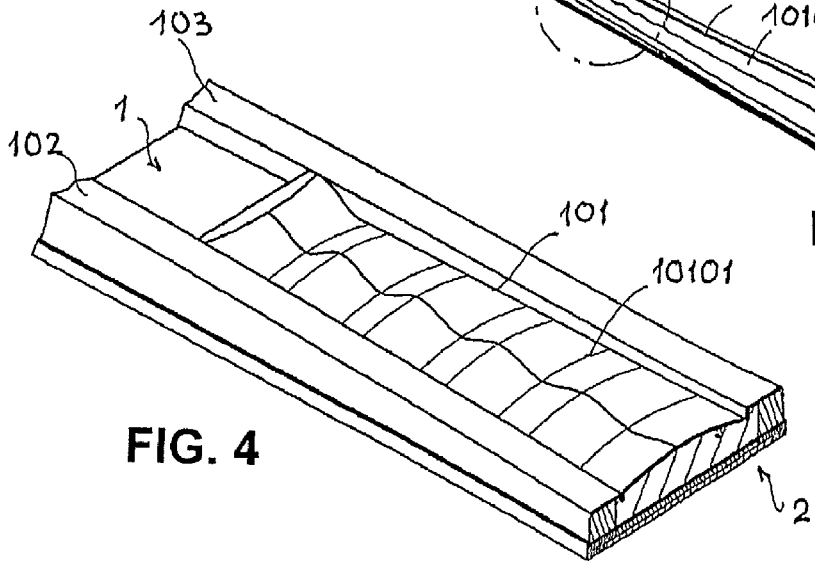
FIG. 4 depicts Detail A according to FIG. 1.

FIG. 1 depicts in a perspective view a ski that basically comprises a middle section 1, a front section 2, and a rear section 3. A ski width b is smallest in the middle section 1 and gradually and continually increases over the front section 2 and rear section 3 of the ski up to the so-called shovel 21 in the front section 2 and the ski tail 31 in the rear section 3 of the ski.

Figure 2:
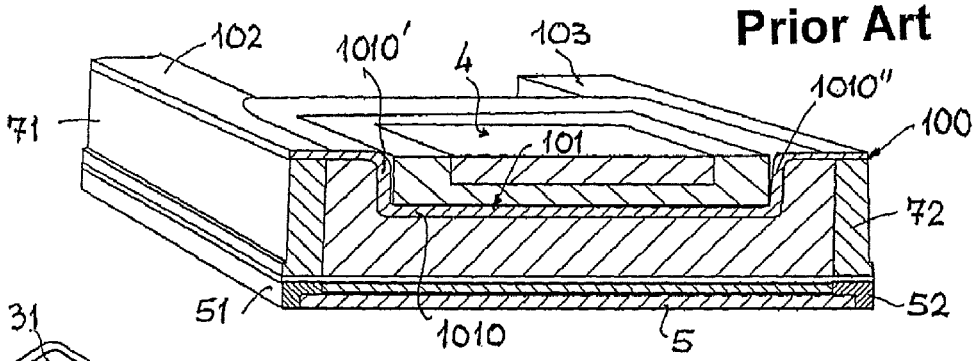
FIG. 2 depicts an example of the ski construction in accordance with an aspect of an embodiment of the invention that is provided with a built-in assembly for the adjustable mounting of the ski binding, in a cross-sectional view of the middle section.

FIG. 2 depicts a cross-section of the ski, specifically of the middle section 1; in the construction depicted, an assembly 4 is provided for the adjustable mounting of the ski binding, a part of which is already built into the ski itself.

Figure 3:
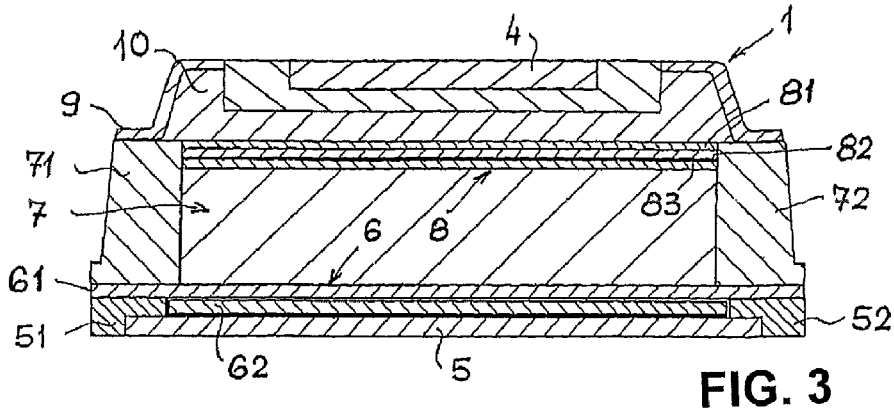
FIG. 3 Prior Art
FIG. 3 depicts a ski in accordance with prior art.

For a better understanding of aspects of embodiments of the invention and in addition to the previously described solutions according to prior art that are also discussed in patent literature, FIG. 3 also depicts an already known solution of the ski in which an assembly 4 for the mounting of the ski binding in the middle section 1 is built in. Such a ski comprises a gliding surface 5 with the edges 51 and 52, over/between which the lower support assembly 6 is placed that is comprised of the support layers 61, 62 that are constructed, for example, from laminate, sheet metal, or other materials with corresponding mechanical properties. Over assembly 6 there is a core 7 with the associated lateral flanks 71, 72. Over core 7 is located the upper support assembly 8 comprised, in an aspect of an embodiment of laminate layers, in general, possibly also of metal and other support layers 81, 82, 83; above this support assembly 8 is located a top layer 9 that protects the components and assemblies placed beneath it from undesired weathering effects and other influences as well as mechanical damage; simultaneously, it also serves, however, to ensure the corresponding appearance of the ski. For the installation requirements of the mentioned assembly 4, the ski is equipped in the middle section 1 with a plate 10 in which, in the depicted example, the assembly 4 is built in and which is thus located over the support elements, i.e., over the support assemblies 6 and 8 that are spaced apart from each other by means of core 7, whereby, despite the installation of the mentioned assembly 4, a corresponding flexural rigidity of the ski is maintained. In this solution, the distance between the ski binding mounting region and the respective associated edge 51, 52, i.e., between assembly 4 and the respective associated edge 51, 52, i.e., in the example depicted, is relatively large so that the transfer of forces from the foot or boot to the edge 51, 52 can be substantially impaired by an entire series of structural elements.

The result of this is that the available force on the edge 51, 52 for maintaining the required pressure on the edge 51, 52 and thus for maintaining the ski in the desired direction is often insufficient, especially when large torsional deformations are present, which the construction comprised of the multilayered support assemblies 6, 8 arranged above or below the core 7 cannot prevent to a sufficient degree.

In a ski according to aspects of embodiments of the invention, as it is constructed here in cross-section 2, analogously to that in FIG. 3, FIG. 2 shows that the upper support assembly 8 is replaced by a uniform shell-shaped support 100 that is placed over the core 7 and optionally under the top layer 9, whereby optionally the installation of the assembly 4 to mount the ski binding is also possible.

A ski according to aspects of embodiments of the invention thus, or further, comprises the gliding surface 5 with the edges 51, 52 and the lower support group 6 comprised of a corresponding number of laminate layers 61, 62, above which the core 7 with the associated lateral flanks 71, 72 is installed. Over core 7 and lateral flanks 71, 72 is placed support 100 that is constructed as a uniform whole from the correspondingly shaped sheet metal, or a corresponding plate or lamination or a similar flat semi-finished product of metallic or non-metallic material.

Support 100 is rigidly connected with the core 7 and the lateral flanks 71, 72 and, as mentioned, constructed as a uniform whole, whereby its two support regions are located in at least two planes. Support 100 comprises, namely at least in the front section 2 of the ski and in the rear section 3 of the ski, at least one indentation 101 in each that is arranged over core 7 and is located in the vicinity of the neutral bending axis or in the axis itself, whereby it comprises the external support regions 102, 103, extending over the middle section 1, over the front section 2, and the rear section 3 of the ski, which are located over its respective lateral flanks 71, 72 and that are arranged at a corresponding distance from the neutral bending axis.

The external support regions 102, 103 of the support 100 can be flat and smooth or can generally also be constructed differently, whereby they essentially run over the upper surface of the ski and in the longitudinal direction on the entire length of the ski, specifically from ski tail 31 to shovel section 21 or vice versa, i.e., over the middle section 1 as well as over the entire front section 2 and rear section 3 of the ski. Accordingly, the width $B_0$ (FIGS. 8 to 12) of the respective external support region 102, 103 of support 100 can, generally speaking, be invariable or variable in the longitudinal direction, specifically in such a manner, for example, that it gradually increases or decreases either along the front section 2 toward the shovel section 21 or along the rear section 3 of the ski toward the ski tail 31.

The mentioned indentation 101 of the support 100 is comprised of a bottom 1010 with the associated walls 1010', 1010", whereby the configuration of this indentation 101, particularly its bottom 1010, thus has a highly efficient effect in a surprisingly simple manner has a surprisingly great effect on the flexural rigidity and even more particularly on the torsional rigidity of the support 100 and thus the entire ski.

The width B of the mentioned indentation 101 or its bottom 1010 changes in the longitudinal direction of the ski, namely along the front section 2 and the rear section 3 of the ski from a width $B_1$ to a width $B_2$, and specifically either in accord with the changing width b of the ski (FIG. 8) or, also in another manner, in an aspect of an embodiment proportionally with the change of the width b of the ski along the front section 2 and rear section 3 respectively of the ski (FIGS. 9 to 12).

The bottom 1010 of the indentation 101 is relief-like according to aspects of embodiments of the invention, whereby the bottom 1010, along the front section 2 or the rear section 3 respectively of the ski, forms a set of periodically repeating upward and downward arcs 10101 that are constructed either as cambered field, or waves of a sinusoid or also in a different manner.

A spacing or a period t of the upward and downward arcs 10101 in each set running along the front section 2 or rear section 3 of the ski in the respective indentation 101 on the support 100 can be either non-variable or can change gradually in the longitudinal direction, i.e., it can decrease or increase from an initial value $t_1$ to a final value $t_2$, viewed in the direction from the middle section 1 of the ski toward the shovel 21 or ski tail 31 or vice versa.

FIG. 5 depicts an aspect of an embodiment in which upward and downward arcs 10101 are constructed as waves of a sinusoid, while the period or spacing t along the ski is thus unchanged on the front section 2 as it is on the rear section of the ski.

FIG. 6 depicts an aspect of an embodiment in which upward and downward arcs 10101 are constructed as waves of a sinusoid, while the period or spacing t along the ski is variable; in this case, it increases from the middle section 1 along the rear section 3 toward the ski tail 31 and along the front section 2 toward the shovel 21 respectively from a minimum value $t_1$ to a maximum value $t_2$.

FIG. 7 depicts an aspect of an embodiment in which upward and downward arcs 10101 are constructed as waves of a sinusoid, while the period or spacing t along the ski is variable; in this case, it increases or decreases from the middle section 1 along the rear section 3 toward the ski tail 31 and along the front section 2 toward shovel 21 respectively from a minimum value $t_1$ to a maximum value $t_2$.

FIG. 8 depicts an aspect of an embodiment of a ski construction in which support regions 102, 103 are located in one plane, while the bottom 010 of indentation 101 is located in another plane. The width B of indentation 101 varies along the ski, specifically in such a manner that it increases in the direction from the middle section 1, from the initial width $B_1$, along the front section 2 toward the shovel 21 or along the rear section 3 toward the ski end 31 toward the maximum value $B_2$. In doing so, the width $B_0$ of the support regions 102, 103 remains basically unchanged, even though it can also vary.

FIG. 9 depicts an aspect of an embodiment of a ski construction in which support regions 102, 103 are located in one plane, while the bottom 1010 of the indentation 101 is located in another plane.

A width of indentation 101 varies along the ski, specifically in such a manner that it increases in the direction from the middle section 1, from the initial width $B_1$, along the front section 2 toward the shovel 21 and along the rear section 3 toward the ski end 31 respectively toward the maximum value $B_2$. In doing so, the width $B_0$ of the supporting regions 102, 103 remains at least basically unchanged, even though it can also vary. The bottom 1010 of the indentation 101 is provided with sine-shape constructed upward and downward arcs 10101, whose spacing t increases along the ski in a direction away from middle section 1 similar to the spacing in FIG. 6 from an initial value $t_1$ to a final value $t_2$.

FIG. 10 depicts aspect of an embodiment of a ski construction, in which supporting region 102, 103 is located in one plane, while the bottom 1010 of indentation 101 is located in another plane. The width B of the indentation 101 varies along the ski, specifically in such a manner that it increases in the direction from the middle section 1, from the initial width $B_1$, along the front section 2 toward the shovel 21 and along the rear section 3 toward the ski end 31 respectively toward the maximum value $B_2$. In doing so, the width $B_0$ of the supporting region 102, 103 remains at least basically unchanged, even though it can vary. The bottom 1010 of indentation 101 is provided with upward and downward arcs 10101, which are constructed as periodically repeating cambers, whereby the period t along the ski in the direction away from the middle section 1 increases from an initial value $t_1$ to a final value $t_2$, similar as in FIG. 6.

FIG. 11 depicts aspect of an embodiment of the ski construction in which support regions 102, 103 are located in one plane while the bottom 1010 of the indentation is located in another plane. The width B of the indentation 101 changes along the ski, specifically in such a manner that it increases in the direction from the middle section 1 from the initial width $B_1$, along the front section 2 toward the shovel 21 and along the rear section 3 toward the ski end 31 respectively toward the maximum value $B_2$. In doing so, the width $B_0$ of the support regions 102, 103 remains at least essentially unchanged, even though it may also vary. The bottom 1010 of the indentation 101 is provided with upward and downward arcs 10101 that are constructed as waves of a sinusoid, whereby the period t increases along the ski in the direction away from the middle section 1, from an initial value $t_1$ to a final value $t_2$, as in FIG. 6. In doing so, the depth of the indentation 101, i.e., the distance between the plane in which the support regions 102, 103 are located and the plane of the bottom 101 in a direction away from the middle section, decreases.

FIG. 12 depicts aspect of an embodiment of a ski construction in which supporting regions 102, 103 are located in one plane, while the bottom 1010 of the indentation 101 is located in another plane. The width B of the indentation 101 changes along the ski, specifically in such a manner that it increases in the direction from the middle section 1, from an initial width $B_1$, along the front section 2 toward the shovel 21 and along the rear section 3 toward the ski end 31 respectively toward the maximum value $B_2$. In doing so, the width $B_0$ of the support regions 102, 103 remains at least essentially unchanged, even though it may also vary. The bottom 1010 of indentation 101 is provided with upward and downward arcs 10101, which are constructed as periodically repeating cambers, whereby the period t along the ski increases in the direction away from the middle section 1, from an initial value $t_1$ to a final value $t_2$, in a manner similar as in FIG. 6. In doing so, the depth of the indentation 101, i.e., the distance between the planes in which the support regions 102, 103 are located, and the plane of the bottom 101 in a direction away from the middle section, decreases.

Thanks to an installation or a presence of the support 100, a ski according to aspects of an embodiment is characterized by numerous advantages. On the one hand, a ski provided with support 100 can be easily constructed either as a carving or traditional ski for alpine skiing, as well as a freestyle ski or as a ski for any other type of skiing, including water-skiing, and furthermore as either a ski with the built-in assembly 4 for the positioning of the ski binding, or without such an assembly 4. Furthermore, for the ski, an additional top layer can be secured easily over the support 100, e.g., for aesthetic or other reasons, which, however, is basically not absolutely necessary. In particular, it may be important, however, that the configuration of the support 100, in particular, also the distance between the bottoms 1010 of the indentation 101 in the front section 2 and in the rear section 3 of the ski and between the external support regions 102, 103, also the configuration of the external support regions 102, 103, particularly in regard to width $B_0$, also the configuration of the indentation 101, including its width B, $B_1$, $B_2$ along the front section 2 and rear section 3 of the ski and the bottom 1010, taking into account the construction itself of the upward and downward arcs 10101, running in the form of cambers or a sinusoid along the ski, of the variable or non-variable spacing or periods t, $t_1$, $t_2$, offers an exceptionally wide range of possibilities in selecting and adjusting the flexural and torsional rigidity of the ski as a whole. In particular, an advantageous effect of the installation of the support 100 is also evident in the substantially shorter distance of the transfer of force from the ski binding mounting area, i.e., from support 100 to each associated ski edge 51, 52, since the distance between the bottoms 1010 of the respective indentations 101 of the support 100 along the entire front section 2 and rear section 3 of the ski is relatively short. Because the support 100 is correspondingly rigid in terms of torsion and flex, the compressive force on the respective edge 51, 52 in the front section 2 and in the rear section 3 of the ski is correspondingly large.

For a snowboard, the effects of installing the support 100 are identical to those described for the ski.

The invention claimed is:

1. A Ski or snowboard having improved torsional rigidity, the ski or snowboard comprising:

(a) a middle section including a location (i) provided for mounting a ski binding on an upper surface, or (ii) in which is provided at least one part of an assembly for an adjustable mounting of a ski binding;

(b) a front section arranged forward of the middle section and joining a shovel to the middle section;

(c) a rear section arranged rearward of the middle section and joining a tail or an additional shovel to the middle section;

(d) a gliding surface arranged between a pair of edges, each extending substantially from the shovel to the tail or additional shovel;

(e) a lower support assembly comprising a number of support layers, the lower support layers provided over the gliding surface and/or the pair of edges;

(f) a core provided over the lower support assembly and, optionally surrounded with lateral flanks and/or a top layer as protection against undesired external influences and mechanical damage; and (g) a support arranged over the core, the support comprising support elements comprising external support regions, walls, and a bottom defined by a number of indentations, the support elements and the number of indentations arranged in at least two distanced planes, (i) wherein a width of the middle section of the ski or snowboard is smaller than a width of the front section and a width of the rear section of the ski or snowboard;

(ii) wherein at least one of the planes of the number of indentations is located in a vicinity of the neutral bending axis or substantially coincides with the neutral bending axis, while the plane or planes of the external support regions are arranged a distance from the neutral bending axis in a direction away from the gliding surface;

(iii) wherein the support is provided in the front section and in the rear section or at least in the middle section with at least one indentation in each, while the external support regions run over the middle section as well as over the front section and rear section; and (iv) wherein at least one indentation forms in a longitudinal direction in the front section or the rear section of the ski or snowboard a set of periodically repeating upward and downward arcs, constructed as cambered fields or sine-shaped arcs.

2. The ski or snowboard according to claim 1, wherein the width of the number of indentations or bottom varies from a minimum width to a maximum width along the longitudinal direction of the front section of the ski or snowboard in proportion with the change in the width of the ski or snowboard.

3. The ski or snowboard according to claim 1, wherein the width of the number of indentations or bottom varies from a minimum width to a maximum width along the longitudinal direction of the rear section of the ski or snowboard in proportion with the change in the width of the ski or snowboard.

4. The ski or snowboard according to claim 1, wherein the width of the number of indentations or bottom varies from a minimum width to a maximum width along the longitudinal direction of the front section and rear section of the ski or snowboard in proportion with the change in the width of the ski or snowboard.

5. The ski or snowboard according to claim 1, wherein a width of the external support regions of the support remains substantially unchanged along the front section of the ski or snowboard.

6. The ski or snowboard according to claim 1, wherein a width of the external support regions of the support remains substantially unchanged along the rear section of the ski or snowboard.

7. The ski or snowboard according to claim 1, wherein a width of the external support regions of the support remains substantially unchanged along the front section and rear section of the ski or snowboard.

8. The ski or snowboard according to claim 1, wherein a spacing or period (t) of the upward or downward arcs remains substantially unchanged in a set running along the number of indentations of the support in the front section of the ski or snowboard.

9. The ski or snowboard according to claim 1, wherein a spacing or period (t) of the upward or downward arcs remains substantially unchanged in a set running along the number of indentations of the support in the rear section of the ski or snowboard.

10. The ski or snowboard according to claim 1, wherein a spacing or period (t) of the upward or downward arcs remains substantially unchanged in sets running along the number of indentations of the support in the front section and rear section of the ski or snowboard.

11. The ski or snowboard according to claim 1, wherein a spacing or period (t) of the upward or downward arcs gradually varies in a set running along the number of indentations of the support in the front section of the ski or snowboard so that, when viewed in a direction away from the middle section of the ski or snowboard, the spacing or period (t) gradually decreases from an initial value to a final value.

12. The ski or snowboard according to claim 1, wherein a spacing or period (t) of the upward or downward arcs gradually varies in a set running along the number of indentations of the support in the rear section of the ski or snowboard so that, when viewed in a direction away from the middle section of the ski or snowboard, the spacing or period (t) gradually decreases from an initial value to a final value.

13. The ski or snowboard according to claim 1, wherein a spacing or period (t) of the upward or downward arcs or sine-shaped arcs gradually varies in sets running along the number of indentations of the support in the front section and rear section of the ski or snowboard so that, when viewed in a direction away from the middle section of the ski or snowboard, the spacing or period (t) gradually decreases from an initial value to a final value.

14. The ski or snowboard according to claim 1, wherein a spacing or period (t) of the upward or downward arcs or sine-shaped arcs gradually varies in a set running along the number of indentations of the support in the front section of the ski or snowboard so that, when viewed in a direction away from the middle section of the ski or snowboard, the spacing or period (t) gradually increases from an initial value to a final value.

15. The ski or snowboard according to claim 1, wherein a spacing or period (t) of the upward or downward arcs or sine-shaped arcs gradually varies in a set running along the number of indentations of the support in the rear section of the ski or snowboard so that, when viewed in a direction away from the middle section of the ski or snowboard, the spacing or period (t) gradually increases from an initial value to a final value.

16. The ski or snowboard according to claim 1, wherein a spacing or period (t) of the upward or downward arcs or sine-shaped arcs gradually varies in sets running along the number of indentations of the support in the front and rear section of the ski or snowboard so that, when viewed in a direction away from the middle section of the ski or snowboard, the spacing or period (t) gradually increases from an initial value to a final value.

17. The ski or snowboard according to claim 1, wherein a width of each of the external support regions of the support varies along the front section and the rear section of the ski or snowboard.

18. The ski or snowboard according to claim 1, wherein a depth of the number of indentations or a distance between the plane in which the bottom of the number of indentations is located and the plane in which the support regions are located varies along the front section and/or rear section.

19. A method for improving the torsional rigidity of a ski or snowboard comprising:

(a) providing a middle section including a location
  (i) provided for mounting a ski binding on an upper surface, or
  (ii) in which is provided at least one part of an assembly for an adjustable mounting of a ski binding; and
(b) providing a front section forward of the middle section and joining a shovel to the middle section;
(c) providing a rear section rearward of the middle section and joining a tail or an additional shovel to the middle section;
(d) providing a gliding surface between a pair of edges, each extending substantially from the shovel to the tail or additional shovel;
(e) providing a lower support assembly comprising a number of support layers, the lower support layers provided over the gliding surface and/or the pair of edges;
(f) providing a core provided over the lower support assembly and, optionally, surrounded with lateral flanks and/or a top layer as protection against undesired external influences and mechanical damage; and
(g) providing a support over the core, the support comprising support elements comprising external support regions, walls, and a bottom defined by a number of indentations, the support elements and the number of indentations arranged in at least two distanced planes,
  (i) wherein a width of the middle section of the ski or snowboard is smaller than a width of the front section and a width of the rear section of the ski or snowboard;
  (ii) wherein at least one of the planes of the number of indentations is located in a vicinity of the neutral bending axis or substantially coincides with the neutral bending axis, while the plane or planes of the external support regions are arranged a distance from the neutral bending axis in a direction away from the gliding surface;
  (iii) wherein the support is provided in the front section and in the rear section or at least in the middle section with at least one indentation in each, while the external support regions run over the middle section as well as over the front section and rear section; and
  (iv) wherein at least one indentation forms in a longitudinal direction in the front section or the rear section of the ski or snowboard a set of periodically repeating upward and downward arcs constructed as cambered fields, or sine-shaped arcs.

20. A method for making a torsionally rigid ski or snowboard comprising (a) providing a middle section including a location
  (i) provided for mounting a ski binding on an upper surface, or
  (ii) in which is provided at least one part of an assembly for an adjustable mounting of a ski binding;
(b) adding a front section forward of the middle section and joining a shovel to the middle section;
(c) adding a rear section rearward of the middle section and joining a tail or an additional shovel to the middle section;
(d) providing a gliding surface between a pair of edges, each extending substantially from the shovel to the tail or additional shovel;
(e) providing a lower support assembly comprising a number of support layers, the lower support layers provided over the gliding surface and/or the pair of edges;
(f) providing a core provided over the lower support assembly and, optionally, surrounded with lateral flanks and/or a top layer as protection against undesired external influences and mechanical damage; and
(g) providing a support over the core, the support comprising support elements comprising external support regions, walls, and a bottom defined by a number of indentations, the support elements and the number of indentations arranged in at least two distanced planes,
  (i) wherein a width of the middle section of the ski or snowboard is smaller than a width of the front section and a width of the rear section of the ski or snowboard;
  (ii) wherein at least one of the planes of the number of indentations is located in a vicinity of the neutral bending axis or substantially coincides with the neutral bending axis, while the plane or planes of the external support regions are arranged a distance from the neutral bending axis in a direction away from the gliding surface;
  (iii) wherein the support is provided in the front section and in the rear section or at least in the middle section with at least one indentation in each, while the external support regions run over the middle section as well as over the front section and rear section; and
  (iv) wherein at least one indentation forms in a longitudinal direction in the front section or the rear section of the ski or snowboard a set of periodically repeating upward and downward arcs constructed as cambered fields, or sine-shaped arcs.

* * * * *